US005772470A

United States Patent [19]

Togashi

[11] Patent Number: 5,772,470

[45] Date of Patent: Jun. 30, 1998

[54] COAXIAL CONNECTOR

[75] Inventor: Kouji Togashi, Tokyo, Japan

[73] Assignee: SMK Corporation, Tokyo, Japan

[21] Appl. No.: 761,241

[22] Filed: Dec. 6, 1996

[30] Foreign Application Priority Data

Jun. 3, 1996 [JP] Japan ..... 8-139799
Jun. 3, 1996 [JP] Japan ..... 8-139800

[51] Int. Cl.[6] ..... H01R 9/07

[52] U.S. Cl. ..... 439/582; 439/582

[58] Field of Search ..... 439/582, 578, 439/854, 855, 394, 63, 581, 585, 859

[56] References Cited

U.S. PATENT DOCUMENTS 4,772,222 9/1988 Laudig et al. ..... 439/578
4,911,660 3/1990 Alf et al. ..... 439/582
5,569,049 10/1996 Tatebe et al. ..... 439/582

FOREIGN PATENT DOCUMENTS 4-282580 10/1992 Japan .
8-17523 1/1996 Japan .

*Primary Examiner*—Gary F. Paumen
*Assistant Examiner*—Tho D. Ta
*Attorney, Agent, or Firm*—Pearne, Gordon, McCoy and Granger LLP

[57] ABSTRACT

In a coaxial connector, a casing, which is connected to an outer conductor of a horizontally-extending coaxial cable, and holds an insulator in surrounding relation thereto, comprises an inner casing and an outer casing connected together through engagement projections and so on. The inner casing of an integral construction includes a vertically-extending external terminal portion of a tubular shape having a slit formed in its front end, insulator holder portions extending upwardly respectively from opposite sides of an upper end of the external terminal portion, a connecting plate portion extending from a rear upper end of the external terminal portion, and outer conductor clamping piece portions extending upwardly respectively from opposite side edges of the connecting plate portion. The outer casing includes an upper plate portion closing an upper side of the insulator holder portions. The coaxial connector provides a good assembling efficiency and good quality stability.

4 Claims, 9 Drawing Sheets

COAXIAL CONNECTOR

BACKGROUND OF THE INVENTION a) Field of the Invention

This invention relates to a coaxial connector, such as a surface mounting-type coaxial connector for use in a portable telephone, a car telephone and a PHS, (Personal Handy-phone System), onto which a coaxial cable is connected to extend in a direction generally perpendicular to a direction of fitting of the connector on a mating connector (that is, a direction of projecting of a terminal portion of the connector).

b) Related Art

A surface mounting-type coaxial connector, disclosed in Japanese Patent Unexamined Publication No. 8-17523, comprises a contact (central contact), an insulator, and a casing (shield casing).

The contact of an integral construction includes a downwardly-projecting central terminal portion (44), and central conductor clamping piece portions (conductor clamping portions 46) for clamping a central conductor of a coaxial cable. The insulator of an integral construction includes a contact holder portion, which has an upper holder groove (receiving recess 52) receiving the central conductor clamping piece portions of the contact and so on, and a terminal mounting hole (contact insertion hole 50) receiving the central terminal portion of the contact, and a lid piece portion (74) closing the upper side of the upper holder groove.

The casing of an integral construction includes a downwardly-open, tubular external terminal portion (shell portion 32), an insulator holder portion (cylindrical portion 58) holding the insulator in surrounding relation to the outer periphery of the insulator, an upper plate portion (lid plate 56) closing the upper side of the insulator holder portion, and outer conductor clamping piece portions (braid clamping portions 38) for horizontally clamping an outer conductor of the coaxial cable.

In this specification, the terms "vertical", "upward" and "downward" mean a direction generally parallel to a direction of fitting of the connector on a mating connector, and the term "upward" means the direction opposite to the direction of fitting of the connector on the mating connector, and the term "downward" means the direction of fitting of the connector on the mating connector. The terms "horizontally", "forward" and "rearward" mean a direction generally perpendicular to the direction of fitting of the connector on the mating connector, and the term "forward" means the direction opposite to the direction of extending of the coaxial cable, and the term "rearward" means the direction of extending of the coaxial cable. Similar terms, such as "upwardly", "downwardly" and "rearwardly", are used in the same senses as above.

In the casing of the above surface mounting-type coaxial connector before the assembly, the insulator holder portion (58) projects upwardly from the upper end of the external terminal portion (32), and the upper plate portion (56) projects upwardly from the upper end of the front portion of the insulator holder portion (58), and the outer conductor clamping piece portions (38) project rearwardly form opposite side edges of a connecting plate portion projecting upwardly from the upper end of the upper plate portion (56), and are disposed in overhanging relation to the space formed by the insulator holder portion (58).

The insulator is inserted into the insulator holder portion (58) of the casing from the upper side, and the contact is inserted into the upper holder groove (52) and the terminal mounting hole (50) in the insulator, and then the upper plate portion (56) is bent rearwardly at the boundary between this upper plate portion (56) and the insulator holder portion (58) so that the upper plate portion (56) and the external conductor clamping piece portions (38) are projected rearwardly, and then the external conductor clamping piece portions (38) are bent inwardly to clamp the external conductor of the coaxial cable, thus completing the assembly.

Therefore, when the insulator is to be inserted into the space formed by the insulator holder portion (58) of the casing, the external conductor clamping piece portions (38) are obstructive, and the upper plate portion (56) of the casing need to be bent at the boundary between this upper plate portion (56) and the insulator holder portion (58) in an unstable condition in which the coaxial cable has not yet been completely fixed. Therefore, in the subminiature coaxial connector for a portable telephone or the like, the assembling operation is complicated, and can not be easily automated, which results in a problem that variations in the product quality occur.

Further, in the casing of the above surface mounting-type coaxial connector, the external terminal portion (32) has a cylindrical shape with a slit (joint portion 64) formed at its rear end. Therefore, if the rear portion of the coaxial cable connected thereto is lifted upwardly when the connector is fitted on the mating connector fixed to a printed circuit board and so on, the slit (64) of the external terminal portion (32) is likely to be enlarged or opened, which results in a problem that fitting strength becomes small.

SUMMARY OF THE INVENTION

With the above problems in view, it is an object of this invention to provide a coaxial connector which achieves a good assembling efficiency and good quality stability. Another object of the this invention is to provide a coaxial connector which is large in fitting strength.

According to the present invention which solves the above problems, and achieves the above object, there is provided a coaxial connector comprising:

- a contact having a vertically-extending, central terminal portion and connected to a central conductor of a horizontally-extending coaxial cable;
- an insulator surrounding and holding the contact; and
- a casing having a vertically-extending external terminal portion of a tubular shape, connected to an outer conductor of the coaxial cable, and surrounding and holding the insulator; and wherein:
  - the casing comprises an inner casing and an outer casing connected together by means of convex and concave engagement portions engaged with each other;
  - the inner casing of an integral construction includes the external terminal portion,
    - insulator holder portions extending upwardly respectively from opposite sides of an upper end of the external terminal portion,
    - a connecting plate portion extending rearwardly from a rear upper end portion of the external terminal portion, and
    - outer conductor clamping piece portions extending upwardly from opposite side edges of the connecting plate portion, respectively; and
  - the outer casing has an upper plate portion closing an upper side of the insulator holder portions.

In the coaxial connector, a slit is preferably formed in the front side of the external terminal portion of the inner casing, but may be provided in a lateral side portion thereof or other portion thereof.

According to the present invention, there is also provided a coaxial connector comprising:

a contact of an integral construction including:

a downwardly-extending central terminal portion, a connecting portion extending forwardly or rearwardly from an upper end of the central terminal portion, and central conductor clamping piece portions extending upwardly or downwardly respectively form opposite side edges of the connecting portion so as to horizontally clamp a central conductor of a coaxial cable;

an insulator of an integral construction including:

a contact holder portion having an upper holder groove and a terminal mounting hole, the upper holder groove extending horizontally and open upwardly and rearwardly for receiving the connecting portion and the central conductor clamping piece portions, the terminal mounting hole extending from the upper holder groove to a lower end of the contact holder portion for receiving the central terminal portion, and a lid piece portion extending upwardly from the contact holder portion, and is adapted to be bent to close an upper side of the upper holder groove;

an inner casing of an integral construction including:

a downwardly-open, external terminal portion of a tubular shape, insulator holder portions extending upwardly respectively from opposite sides of an upper end of the external terminal portion for holding an outer periphery of the insulator, a connecting plate portion extending rearwardly from the rear upper end of the external terminal portion, and external conductor clamping piece portions extending upwardly respectively from opposite side edges of the connecting plate portion for horizontally clamping an outer conductor of the coaxial cable; and an outer casing of an integral construction including:

a side plate portion engaging and covering outer surfaces of the insulator holder portions of the inner casing, an upper plate portion extending rearwardly from an upper end of a front portion of the side plate portion for closing an upper side of the insulator holder portions, and casing holder piece portions extending downwardly respectively from opposite side edges of a rear portion of the upper plate portion to engage a lower side of the connecting plate portion of the inner casing.

In the coaxial connector, a slit is preferably formed in the front side of the external terminal portion of the inner casing, but may be provided in a lateral side portion thereof or other portion thereof.

According to the present invention, there is also provided a coaxial connector comprising:

a contact having a vertically-extending, central terminal portion and connected to a central conductor of a horizontally-extending coaxial cable;

an insulator surrounding and holding the contact; and a casing having a vertically-extending external terminal portion of a tubular shape, connected to an outer conductor of the coaxial cable, and surrounding and holding the insulator; and wherein:

the casing comprises an inner casing and an outer casing connected together by means of convex and concave engagement portions engaged with each other;

the inner casing of an integral construction includes the external terminal portion and insulator holder portions extending upwardly respectively from opposite sides of an upper end of the external terminal portion;

a vertical slit is formed in a front side of the external terminal portion; and the outer casing has an upper plate portion closing an upper side of the insulator holder portions.

In the coaxial connector, an outer conductor clamping piece portions are preferably provided on the inner casing, but may be provided on the outer casing.

DETAILED DESCRIPTION OF THE PREFERRED EMBODIMENT

Figure 1:
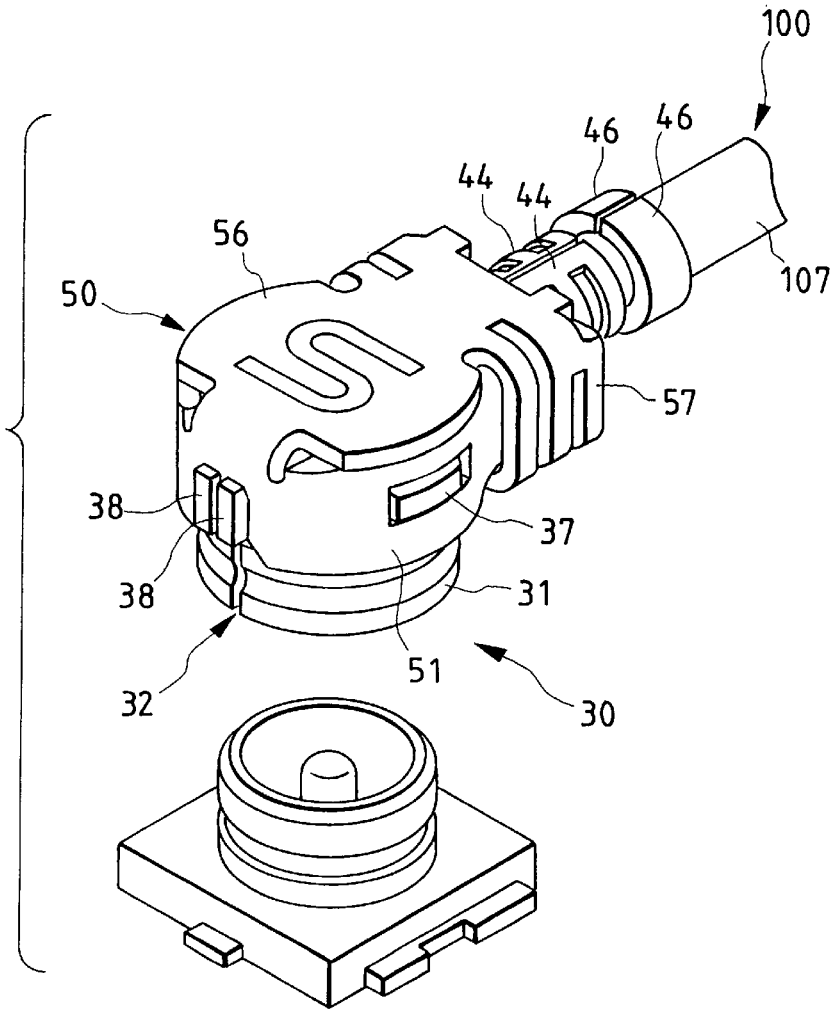
FIG. 1 is a perspective view showing a preferred embodiment of a coaxial connector of the present invention, and a mating connector.
Figure 2:
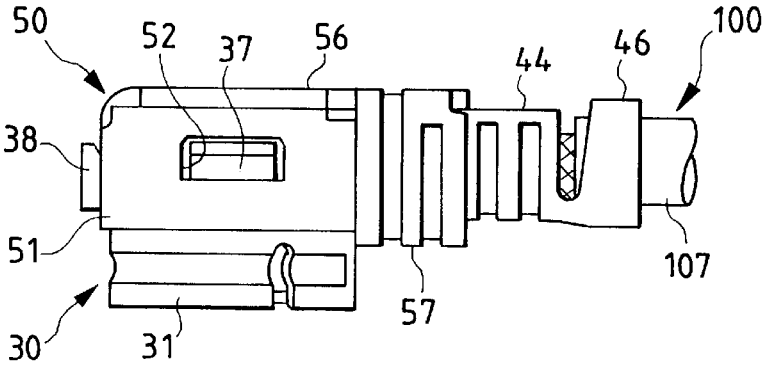
FIG. 2 is a side-elevational view of the coaxial connector of FIG. 1.
Figure 3:
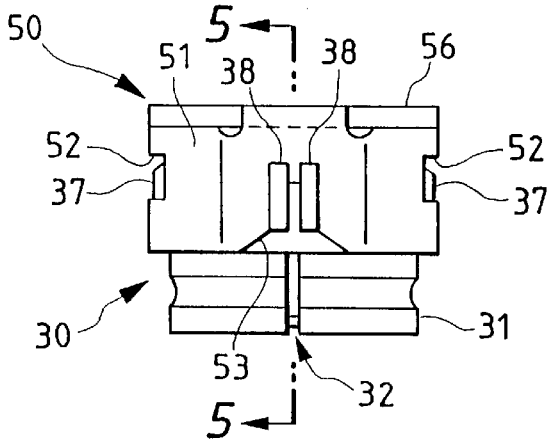
FIG. 3 is a front-elevational view of FIG. 2.
Figure 4:
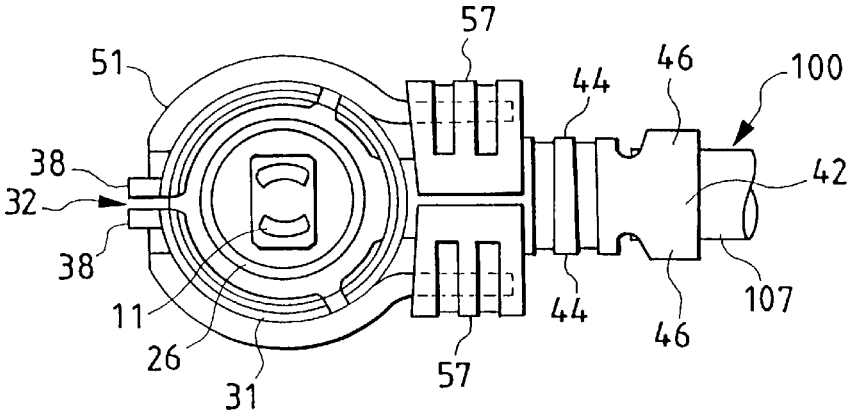
FIG. 4 is a bottom view of FIG. 2.
Figure 5:
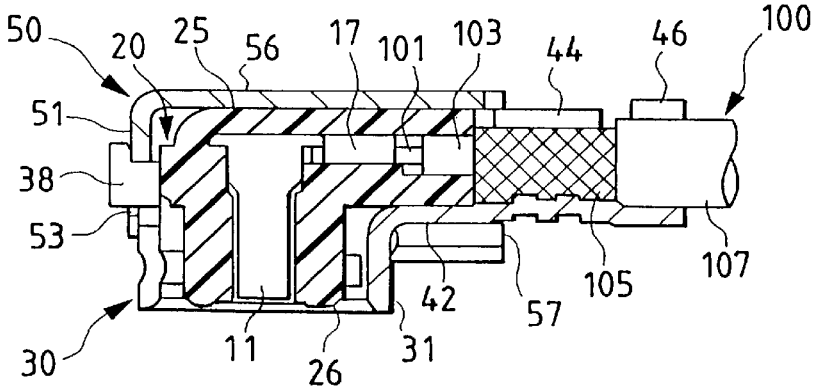
FIG. 5 is a cross-sectional view taken along the line 5—5 of FIG. 3.

One preferred embodiment of the present invention will now be described with reference to the drawings. In the drawings, a coaxial connector, such as a subminiature (the diameter of an external terminal portion is about 2 mm) surface mounting-type coaxial connector, comprises a contact 10, an insulator 20, an inner casing 30, and an outer casing 50. Reference numeral 100 denotes a coaxial cable to which the coaxial connector is connected.

Figure 6:
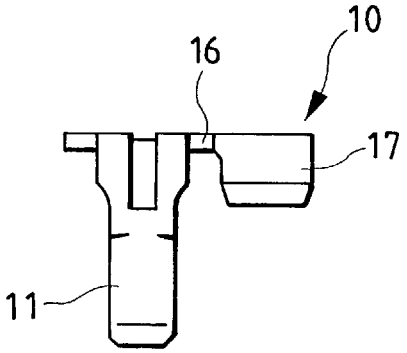
FIG. 6 is a side-elevational view of a contact of the coaxial connector of FIG. 2 (before assembly)
Figure 7:
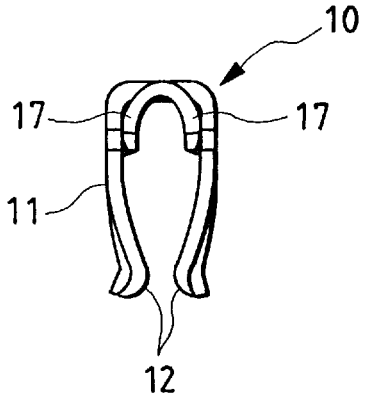
FIG. 7 is a rear view of FIG. 6.
Figure 8:
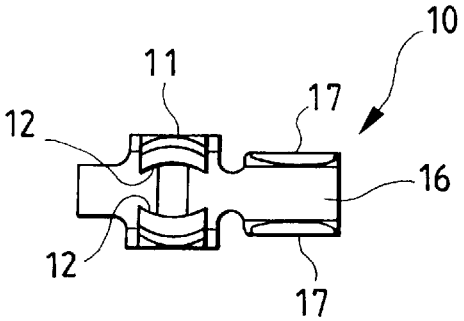
FIG. 8 is a bottom view of FIG. 6.
Figure 9:
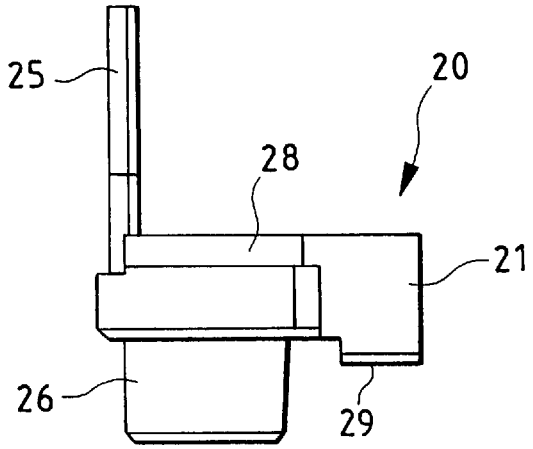
FIG. 9 is a side-elevational view of an insulator of the coaxial connector of FIG. 2 (before assembly)
Figure 10:
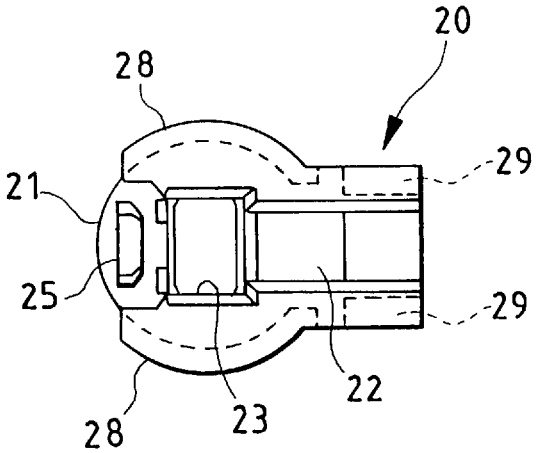
FIG. 10 is a plan view of FIG. 9.
Figure 11:
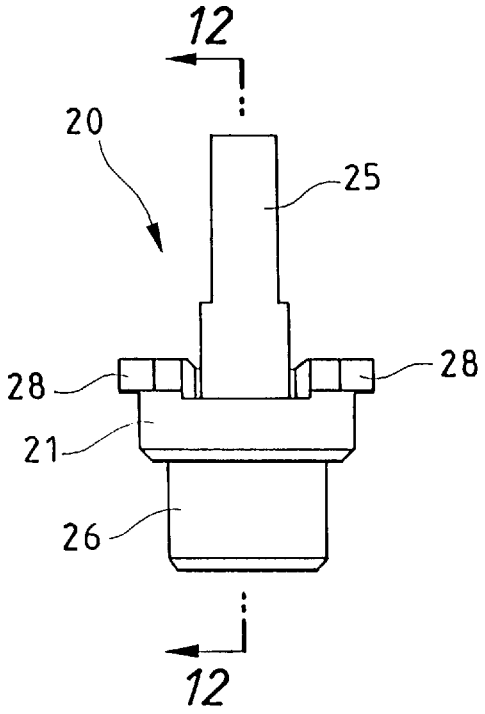
FIG. 11 is a front-elevational view of FIG. 9.
Figure 12:
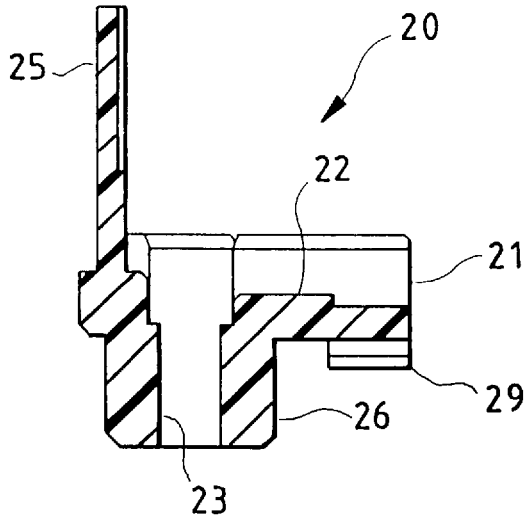
FIG. 12 is a cross-sectional view taken along the line 12—12 of FIG. 11.
Figure 13:
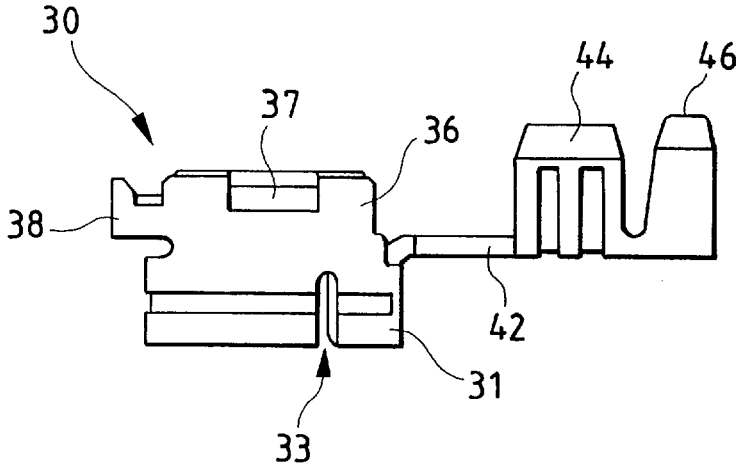
FIG. 13 is a side-elevational view of an inner casing of the coaxial connector FIG. 2 (before assembly)
Figure 14:
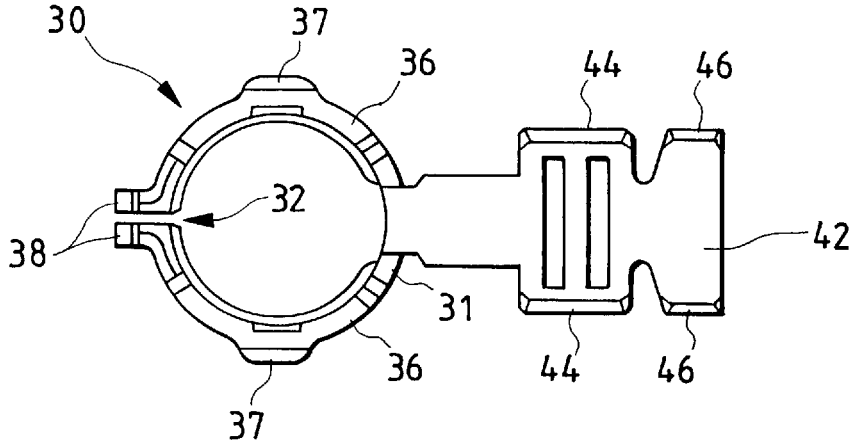
FIG. 14 is a plan view of FIG. 13.
Figure 15:
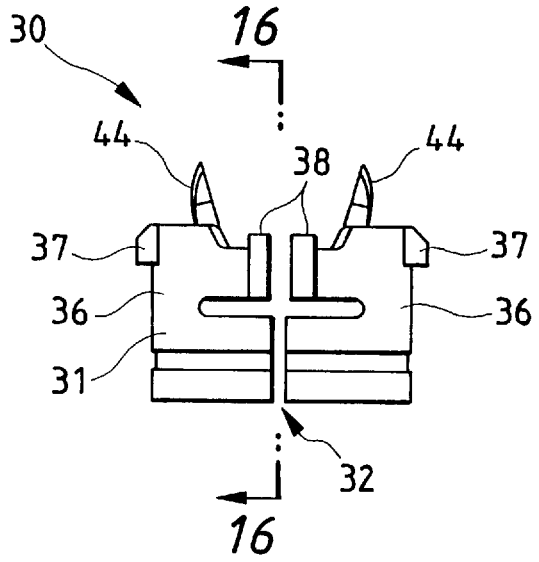
FIG. 15 is a front-elevational view of FIG. 13.
Figure 16:
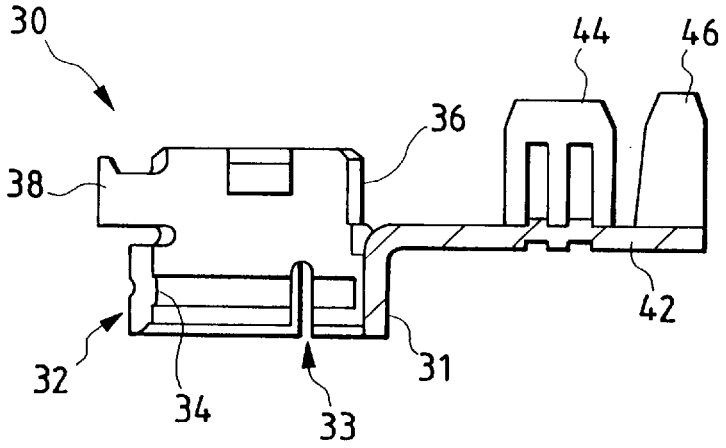
FIG. 16 is a cross-sectional view taken along the line 16—16 of FIG. 15.

As shown in FIGS. 6 to 8, the contact 10 includes a central terminal portion 11 (female terminal) for releasably fitting on a central terminal portion of a mating connector, and central conductor clamping piece portions 17 and 17 for horizontally clamping a central conductor 101 of the coaxial cable 100. This contact 10 of an integral construction is formed by blanking, bending, etc., of a single copper alloy sheet.

The central terminal portion 11 comprises two downwardly-projecting terminal piece portions, and has a downwardly-open, generally inverted U-shaped vertical cross-section. Contact points 12 are respectively formed on and project from the inner sides of the two terminal piece portions at their distal or lower ends. The contact 10 also includes a connecting portion 16 which extends rearwardly from the rear side of the upper end of the central terminal portion 11, and the central conductor clamping piece portions 17 and 17 extend downwardly from the opposite side edges of the connecting portion 16, respectively. Before the assembly, the central conductor clamping piece portions 17 and 17 assume a downwardly-open, generally inverted U-shaped vertical cross-section.

Figure 20:
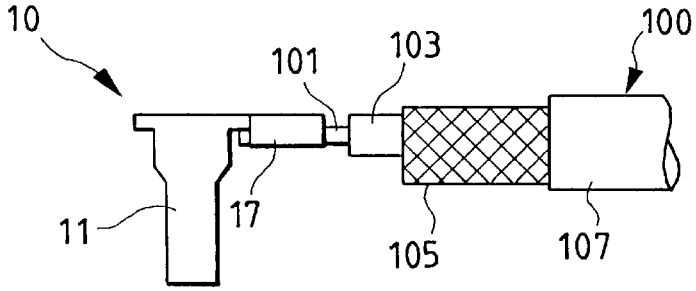
FIG. 20 is a side-elevational view showing a first step of an assembling operation for the coaxial connector of FIG. 5.

The central conductor 101 of the coaxial cable 100 is passed through a space between the central conductor clamping piece portions 17 and 17 of the contact 10, and then the central conductor clamping piece portions 17 and 17 are bent inwardly to hold or embrace the central conductor 101, thereby connecting the contact 10 to the central conductor 101 of the coaxial cable 100, as shown in FIG. 20. Therefore, the central terminal portion 11 extends perpendicular to the direction of the axis of the coaxial cable 100.

As shown in FIGS. 9 to 12, the insulator 20 includes a contact holder portion 21 holding the upper portion of the contact 10, a lid piece portion 25 closing the upper side of the contact holder portion 21, and a fitting portion 26 for fitting in an external terminal portion of the mating connector. This insulator 20 has an integral construction, and is injection molded of a synthetic resin.

The contact holder portion 21 has a front portion of a generally cylindrical shape, and a rear projected portion of a generally rectangular parallelepiped shape. The fitting portion 26 has a generally cylindrical shape, and extends downwardly from the lower side of the front portion of the contact holder portion 21. An upper holder groove 22, which is elongate in the horizontal direction, and is open upwardly and rearwardly, is formed in the upper surface of the contact holder portion 21. A terminal mounting hole 23 is formed in the contact holder portion 21 and the fitting portion 26, and extends downwardly from the upper holder groove 22 to the lower end of the fitting portion 26.

The lid piece portion 25 extends upwardly from the upper surface of the contact holder portion 21 at the front end thereof, and engagement flanges 28 and 28 are formed on and project outwardly from the opposite sides of the front portion of the contact holder portion 21, respectively. Engagement flanges 29 and 29 are respectively formed on and project downwardly from the opposite side portions of the lower surface of the rear projected portion of the contact holder portion 21.

Figure 22:
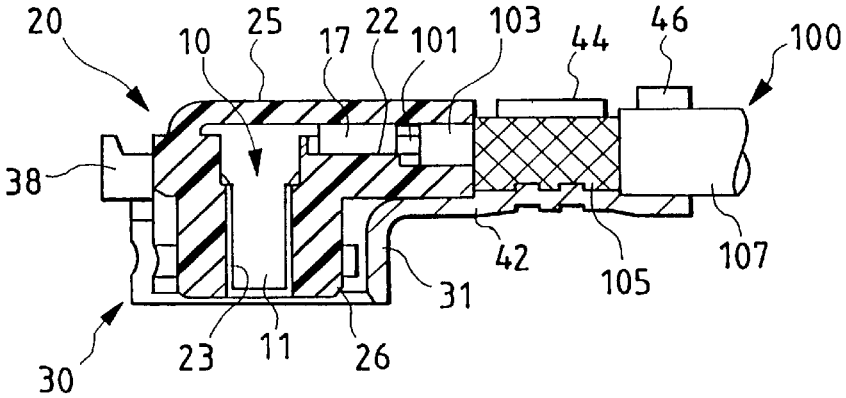
FIG. 22 is a side-elevational view showing a third step of the assembling operation for the coaxial connector of FIG. 5.

The central terminal portion 11 of the contact 10 is inserted into the terminal mounting hole 23 in the insulator 20, and the connecting portion 16, the central conductor clamping piece portions 17 and 17, the central conductor 101 of the coaxial cable 100 and an inner insulator 103 are fitted in the upper holder groove 22, and the lid piece portion 25 is bent rearwardly at its proximal end to cover the upper side of the contact 10, thereby mounting the contact 10, as shown in FIG. 22.

As shown in FIGS. 13 to 16, the inner casing 30 includes an external terminal portion 31 (female terminal) for releasably fitting on the external terminal portion of the mating connector, insulator holder portions 36 and 36 holding the insulator 20, outer conductor clamping piece portions 44 and 44 for horizontally clamping an outer conductor 105 of the coaxial cable 100, and cable clamping piece portions 46 and 46 for clamping an outer insulator (sheath) 107 of the coaxial cable 100. This inner casing 30 has an integral construction, and is formed by blanking, bending, etc., of a single copper alloy sheet.

The external terminal portion 31 of a cylindrical shape is open upwardly and downwardly, and has a vertical slit (joint portion) 32 formed in its front side, and this external terminal portion 31 has vertically-extending notches 33 and 33 formed in a lower edge portion thereof at a rear portion thereof. A horizontally-disposed contact portion 34 is formed on and projects from the inner surface of the external terminal portion 31.

The insulator holder portions 36 and 36 extend upwardly respectively from opposite sides of an upper end of the external terminal portion 31, and jointly form an upwardly-open portion. Engagement projections 37 and 37 are formed on and project outwardly from the outer surfaces of the insulator holder portions 36 and 36, respectively. Upwardly-directed engagement hooks 38 and 38 are respectively formed on and project forwardly from the front ends of the insulator holder portions 36 and 36.

A connecting plate portion 42 extends rearwardly from a rear upper end portion (disposed between the insulator holder portions 36 and 36) of the external terminal portion 31 through a bent portion. The outer conductor clamping piece portions 44 and 44 extend upwardly from opposite side edges of the connecting plate portion 42, respectively, and the cable clamping piece portions 46 and 46 extend upwardly from the opposite side edges of the rear end portion of the connecting plate portion 42, respectively. Before the assembly, the outer conductor clamping piece portions 44 and 44, as well as the cable clamping piece portions 46 and 46, assume an upwardly-open, generally U-shaped vertical cross-section. Therefore, the inner casing 30 has no portion disposed in overhanging relation to the insulator holder portions 36 and 36.

Figure 21:
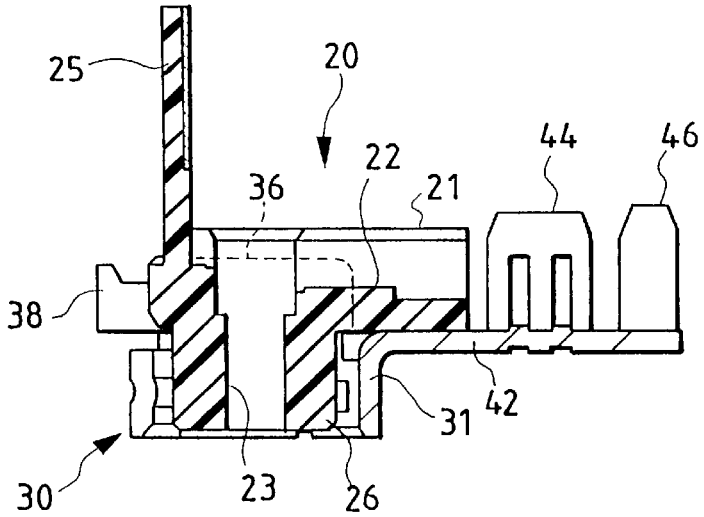
FIG. 21 is a side-elevational view showing a second step of the assembling operation for the coaxial connector of FIG. 5.

The fitting portion 26 of the insulator 20 is inserted into the external terminal portion 31 of the inner casing 30 from the upper side, and the contact holder portion 21 is fitted into a space between the insulator holder portions 36 and 36, with the engagement flanges 28 and 28 abutted respectively against the upper edges of the insulator holder portions 36 and 36, and with the connecting plate portion 42 held between the engagement projections 29 and 29, as shown in FIG. 21. By doing so, the insulator 20 is attached to the inner casing 30. The upper surface of the insulator 20 is exposed from the inner casing 30.

After the outer conductor 105 of the coaxial cable 100 is fitted in a space between the outer conductor clamping piece portions 44 and 44 of the inner casing 30, the outer conductor clamping piece portions 44 and 44 are bent inwardly to hold the outer conductor 105 therebetween, and further after the outer insulator 107 of the coaxial cable 100 is fitted into a space between the cable clamping piece portions 46 and 46, the cable clamping piece portions 46 and 46 are bent inwardly to hold the outer insulator 107 therebetween, as shown in FIG. 22. Thus, the inner casing 30 is connected to the outer conductor 105 of the coaxial cable 100. As a result, the external terminal portion 31 projects perpendicular to the direction of the axis of the coaxial cable 100.

Figure 17:
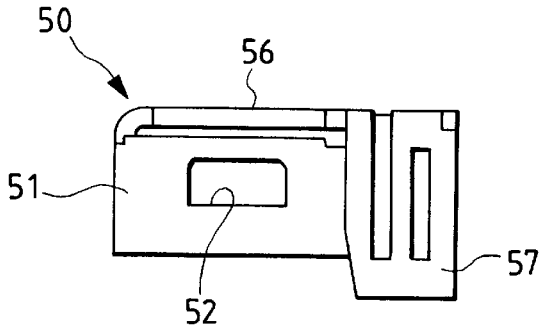
FIG. 17 is a side-elevational view of an outer casing of the coaxial connector of FIG. 2 (before assembly)
Figure 18:
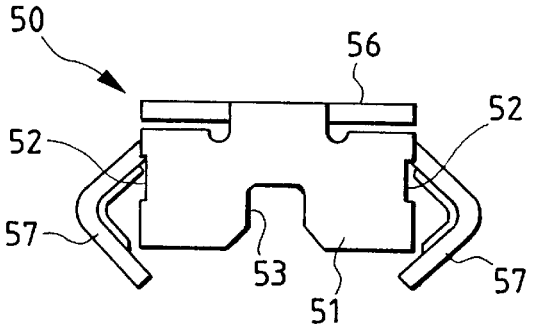
FIG. 18 is a front-elevational view of FIG. 17.
Figure 19:
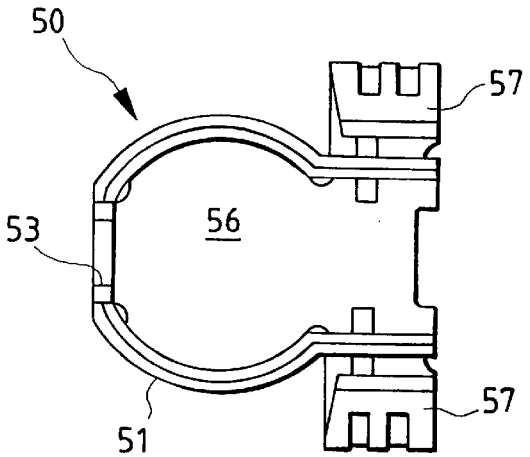
FIG. 19 is a bottom view of FIG. 17.

As shown in FIGS. 17 to 19, the outer casing 50 includes a side plate portion 51 covering the outer surfaces of the insulator holder portions 36 and 36 of the inner casing 30, and an upper plate portion 56 closing the upper side (that is, the upper surface of the insulator 20) of the space formed by the insulator holder portions 36 and 36. This outer casing 50 has an integral construction, and is formed by blanking, bending, etc., of a single copper alloy sheet.

The side plate portion 51 has a front end portion and opposite side portions, and its front portion has a generally C-shaped horizontal cross-section, and is open upwardly, downwardly and rearwardly, and rear portions of the opposite side portions of the side plate portion 51 have a linear horizontal cross-section. Engagement holes 52 and 52 are formed respectively through front portions of the opposite side portions, and a vertically-extending engagement notch 53 is formed in a lower edge portion of the front end portion of the side plate portion 51. The upper plate portion 56 extends rearwardly from the upper edge of the front end portion of the side plate portion 51 through a bent portion, and a front portion thereof has a generally circular shape, and a rear portion thereof has a square shape. The upper plate portion 56 closes the upper side of the space formed by the side plate portion 51.

Casing holder piece portions 57 and 57 extend downwardly from opposite side edges of the rear portion of the upper plate portion 51 of the outer casing 50, respectively, and are disposed outwardly of the rear portions of the opposite side portions of the side plate portion 51, respectively. Before the assembly, the casing holder piece portions 57 and 57 are in a downwardly-open condition.

As shown in FIGS. 1 to 5, the outer casing 50 is fitted on the inner casing 30 from the upper side, and at this time the insulator holder portions 36 and 36 are received in the side plate portion 51, and the engagement projections 37 and 37 are engaged respectively in the engagement holes 52 and 52, and the engagement hooks 38 and 38 are engaged in the engagement notch 53, and the casing holder piece portions 57 and 57 at the rear end portion of the outer casing 50 are bent inwardly to hold the front portion (disposed between the external terminal portion 31 and the outer conductor clamping piece portions 44 and 44) of the connecting plate portion 42 to support the same from the lower side. In this manner, the outer casing 50 is connected to the inner casing 30.

For assembling the coaxial connector comprising the contact 10, the insulator 20, the inner casing 30 and the outer casing 50, the central conductor 101 of the coaxial cable 100 is first fitted in the space between the central conductor clamping piece portions 17 and 17 of the contact 10, and then the central conductor clamping piece portions 17 and 17 are bent inwardly to clamp the central conductor 101, thereby connecting the contact 10 to the central conductor 101 of the coaxial cable 100, as shown in FIG. 20.

As shown in FIG. 21, the fitting portion 26 of the insulator 20 is inserted into the external terminal portion 31 of the inner casing 30 from the upper side, and the contact holder portion 21 is fitted into the space between the insulator holder portions 36 and 36, with the engagement flanges 28 and 28 abutted respectively against the upper edges of the insulator holder portions 36 and 36, and with the connecting plate portion 42 held between the engagement projections 29 and 29. By doing so, the insulator 20 is attached to the inner casing 30.

Then, as shown in FIG. 22, the central terminal portion 11 of the contact 10 is inserted into the terminal mounting hole 23 in the insulator 20, and the connecting portion 16, the central conductor clamping piece portions 17 and 17, the central conductor 101 of the coaxial cable 100 and the inner insulator 103 thereof are fitted in the upper holder groove 22, and the outer conductor 105 of the coaxial cable 100 is fitted in the space between the outer conductor clamping piece portions 44 and 44 of the inner casing 30, and the outer insulator 107 is fitted in the space between the cable clamping piece portions 46 and 46. Then, the lid piece portion 25 of the insulator 20 is bent rearwardly at its proximal end to cover the upper side of the contact 10, and the outer conductor clamping piece portions 44 and 44 of the inner casing 30 are bent inwardly to clamp the outer conductor 105 of the coaxial cable 100, and the cable clamping piece portions 46 and 46 are bent inwardly to clamp the outer insulator 107. Thus, the contact 10 is attached to the insulator 20, and the inner casing 30 is connected to the outer conductor 105 of the coaxial cable 100.

Then, as shown in FIGS. 1 to 5, the outer casing 50 is fitted on the inner casing 30, and at this time the insulator holder portions 36 and 36 are received in the side plate portion 51, and the engagement projections 37 and 37 are engaged respectively in the engagement holes 52 and 52, and the engagement hooks 38 and 38 are engaged in the engagement notch 53, and the casing holder piece portions 57 and 57 are bent inwardly to hold the front portion of the connecting plate portion 42 to support the same from the lower side. In this manner, the inner casing 30 and the outer casing 50 are connected together to positively fix the insulator 20 in an enclosing manner.

The upper plate portion 56 is provided at the outer casing 50, and the external terminal portion 31, the insulator holder portions 36 and 36 and the outer conductor clamping portions 44 and 44 are provided at the inner casing 30, and the outer conductor clamping portions 44 and 44 extend upwardly respectively from the opposite side edges of the connecting plate portion 42 extending rearwardly from the upper end of the rear portion of the external terminal portion 31. Therefore, the inner casing 30 has no portion disposed in overhanging relation to the insulator holder portions 36 and 36, and the insulator 20 can be easily inserted. And besides, the coaxial cable 100 can be soon attached to the inner casing 30 by clamping the external conductor 105, and therefore the assembly is easy, and can be automated, and the quality of the product is stable.

The slit 32 is formed in the front side of the external terminal portion 31 of the inner casing 30, and in this case even if a rear portion of the coaxial cable 100 is lifted when the connector is fitted on the mating connector fixedly mounted on a printed wiring board or the like, the slit 32 in the external terminal portion 31 is hardly opened, thus providing the enhanced fitting strength.

In the above embodiment, although the convex engagement portions (the engagement projections 37 and 37 and the engagement hooks 38 and 38) are provided on the inner casing while the concave engagement portions (the engagement holes 52 and 52 and the engagement notch 53) are provided in the outer casing, the concave engagement portions may be provided in the inner casing, and the convex engagement portions may be provided on the outer casing.

As described above, in the coaxial connector of the present invention, the upper plate portion is provided at the outer casing, and the external terminal portion, the insulator holder portions and the outer conductor clamping portions are provided at the inner casing, and the outer conductor clamping portions extend upwardly respectively from the opposite side edges of the connecting plate portion extending rearwardly from the upper end of the rear portion of the external terminal portion. Therefore, the inner casing has no portion disposed in overhanging relation to the insulator holder portions, and the insulator can be easily inserted. And besides, the coaxial cable can be soon attached to the inner casing by clamping the external conductor, and therefore particularly the assembly of the subminiature coaxial connector for a portable telephone or the like is easy, and the efficiency of the assembly is enhanced, and the stability of the quality is enhanced.

Further, in the coaxial connector of the present invention, since the slit of the cylindrical external terminal portion is provided at its front side, even if the rear portion of the coaxial cable is lifted when the connector is fitted on the mating connector, the slit is hardly opened, thus providing the enhanced fitting strength.

What is claimed is:

1. A coaxial connector comprising:

a contact having a vertically-extending, central terminal portion and connected to a central conductor of a horizontally-extending coaxial cable;

an insulator surrounding and holding said contact; and a casing having a vertically-extending external terminal portion of a tubular shape, connected to an outer conductor of said coaxial cable, and surrounding and holding said insulator; and wherein:

said casing comprises an inner casing and an outer casing connected together by means of convex and concave engagement portions engaged with each other;

said inner casing of an integral construction includes said external al terminal portion, insulator holder portions extending upwardly respectively from opposite sides of an upper end of said external terminal portion, a connecting plate portion extending rearwardly from a rear upper end portion of said external terminal portion, and outer conductor clamping piece portions extending upwardly from opposite side edges of said connecting plate portion, respectively; and said outer casing has an upper plate portion closing an upper side of said insulator holder portions.

2. A coaxial connector according to claim 1, wherein a vertical slit is formed in a front side of said external terminal portion.

3. A coaxial connector comprising:

a contact of an integral construction including:

a downwardly-extending central terminal portion, a connecting portion extending forwardly or rearwardly from an upper end of said central terminal portion, and central conductor clamping piece portions extending upwardly or downwardly respectively form opposite side edges of said connecting portion so as to horizontally clamp a central conductor of a coaxial cable;

an insulator of an integral construction including:

a contact holder portion having an upper holder groove and a terminal mounting hole, said upper holder groove extending horizontally and open upwardly and rearwardly for receiving said connecting portion and said central conductor clamping piece portions, said terminal mounting hole extending from said upper holder groove to a lower end of said contact holder portion for receiving said central terminal portion, and a lid piece portion extending upwardly from said contact holder portion, and is adapted to be bent to close an upper side of said upper holder groove;

an inner casing of an integral construction including:

a downwardly-open, external terminal portion of a tubular shape, insulator holder portions extending upwardly respectively from opposite sides of an upper end of said external terminal portion for holding an outer periphery of said insulator, a connecting plate portion extending rearwardly from the rear upper end of said external terminal portion, and external conductor clamping piece portions extending upwardly respectively from opposite side edges of said connecting plate portion for horizontally clamping an outer conductor of said coaxial cable; and an outer casing of an integral construction including:

a side plate portion engaging and covering outer surfaces of said insulator holder portions of said inner casing, an upper plate portion extending rearwardly from an upper end of a front portion of said side plate portion for closing an upper side of said insulator holder portions, and casing holder piece portions extending downwardly respectively from opposite side edges of a rear portion of said upper plate portion to engage a lower side of said connecting plate portion of said inner casing.

4. A coaxial connector according to claim 3, wherein a vertical slit is formed in a front side of said external terminal portion.

* * * * *